US011697186B2

(12) United States Patent
Breitenmoser

(10) Patent No.: US 11,697,186 B2
(45) Date of Patent: Jul. 11, 2023

(54) ABRASIVE ARTICLE

(71) Applicant: Robert Bosch GmbH, Stuttgart (DE)

(72) Inventor: Josef Breitenmoser, Hüttwilen (CH)

(73) Assignee: Robert Bosch GmbH, Stuttgart (DE)

( * ) Notice: Subject to any disclaimer, the term of this patent is extended or adjusted under 35 U.S.C. 154(b) by 457 days.

(21) Appl. No.: 16/635,116

(22) PCT Filed: Aug. 21, 2018

(86) PCT No.: PCT/EP2018/072506
§ 371 (c)(1),
(2) Date: Jan. 29, 2020

(87) PCT Pub. No.: WO2019/052787
PCT Pub. Date: Mar. 21, 2019

(65) Prior Publication Data

US 2020/0180107 A1 Jun. 11, 2020

(30) Foreign Application Priority Data

Sep. 13, 2017 (DE) ..... 10 2017 216 175.2

(51) Int. Cl.
*B24B 55/10* (2006.01)
*B24D 11/00* (2006.01)

(52) U.S. Cl.
CPC ..... *B24B 55/102* (2013.01); *B24D 11/00* (2013.01)

(58) Field of Classification Search
CPC ..... B24D 3/001; B24D 3/002; B24D 9/08; B24D 9/085; B24D 9/10; B24D 13/14; B24D 13/142; B24D 13/147; B24D 13/18; B24D 3/00; B24D 2203/00; B24D 55/105; B24D 55/102
USPC ..... 451/548, 550, 527
See application file for complete search history.

(56) References Cited

U.S. PATENT DOCUMENTS

| | | | | |
|---|---|---|---|---|
| 5,989,112 | A | 11/1999 | Long | |
| D816,131 | S * | 4/2018 | Nymark | D15/126 |
| D852,243 | S * | 6/2019 | Fritsch | D15/126 |
| 2003/0143926 | A1 | 7/2003 | Piliguian | |
| 2006/0040597 | A1 | 2/2006 | Piliguian | |
| 2007/0243803 | A1 * | 10/2007 | Oka | B24D 11/00 451/527 |
| 2011/0039485 | A1 | 2/2011 | Benner et al. | |

(Continued)

FOREIGN PATENT DOCUMENTS

| | | | |
|---|---|---|---|
| CN | 1213333 | A | 4/1999 |
| CN | 103702801 | A | 4/2014 |
| CN | 104125876 | A | 10/2014 |

(Continued)

OTHER PUBLICATIONS

International Search Report corresponding to PCT Application No. PCT/EP2018/072506, dated Nov. 22, 2018 German and English language document) (6 pages).

*Primary Examiner* — Monica S Carter
*Assistant Examiner* — Abbie E Quann
(74) *Attorney, Agent, or Firm* — Maginot, Moore & Beck LLP

(57) ABSTRACT

An abrasive article, in particular a coated abrasive disc, includes a plurality of holes which are arranged in a hole pattern. The density of holes decreases from an inner region of the hole pattern to an outer region of the hole pattern. At least one hole in the hole pattern is designed as an elongated hole.

20 Claims, 8 Drawing Sheets

(56) References Cited

U.S. PATENT DOCUMENTS

2015/0004889 A1 1/2015 Seth

FOREIGN PATENT DOCUMENTS

| | | | | | |
|---|---|---|---|---|---|
| DE | 20 2007 004 949 | U1 | | 7/2007 | |
| DE | 10 2012 206 708 | A1 | | 10/2013 | |
| DE | 21 2012 000 041 | U1 | | 10/2013 | |
| EP | 0 781 629 | B1 | | 7/1997 | |
| GB | 2515764 | A | * | 1/2015 | ..... B24B 55/06 |
| JP | 58-44165 | U | | 3/1983 | |
| JP | 62-123865 | U | | 8/1987 | |
| WO | 2010/004601 | A1 | | 1/2010 | |
| WO | 2013/102206 | A1 | | 7/2013 | |
| WO | 2015/002865 | A1 | | 1/2015 | |

* cited by examiner

ABRASIVE ARTICLE

This application is a 35 U.S.C. § 371 National Stage Application of PCT/EP2018/072506, filed on Aug. 21, 2018, which claims the benefit of priority to Serial No. DE 10 2017 216 175.2, filed on Sep. 13, 2017 in Germany, the disclosures of which are incorporated herein by reference in their entirety.

The invention disclosure relates to an abrasive article, in particular to a coated abrasive disk, having a plurality of holes which are arranged in a hole pattern, wherein a hole density decreases from an inner region of the hole pattern to an outer region of the hole pattern.

BACKGROUND

Abrasive articles, in particular coated abrasive disks, having a plurality of holes which are arranged in a hole pattern, are known in the prior art, for example from EP 0781629 B1. Such abrasive disks are provided for attachment to an abrasive plate of an abrasive instrument, in particular of an orbital sander. Such abrasive instruments typically comprise a dust extraction system by means of which material removed, in particular abrasive dust, from a processing surface during the abrasive process, is extracted through the holes of the abrasive disk during an abrasive process.

U.S. Pat. No. 5,989,112 and DE 202007004949 U1 additionally disclose choosing a form of holes of the hole pattern in such a manner that the abrasive article is able to be used with a plurality of different abrasive plates which comprise, in particular, a differing number of holes and/or slightly different hole patterns. In particular, at least some holes of the abrasive article comprise an elongated design for this purpose.

WO 2015/002865 discloses an abrasive article with a plurality of holes which are arranged in a hole pattern, the hole pattern comprising a first inner region with at least one hole and a second outer region with at least one hole, the second region being arranged concentrically about the first region and about a central hole of the hole pattern, in addition a hole density for the respective region being defined from a size of the holes and a number of the holes and the hole density of the first inner region being smaller than the hole density of the second outer region.

There is a constant need in the abrasives industry to increase further the material removal during the machining of work surfaces with at the same time preventing the abrasive article being clogged by the removed material, in particular abrasive dust. Clogging of the abrasive article surface is to be avoided, in particular, in order not to reduce the effectiveness of the abrasive article and in addition in order to counter an increase in a probability of scratch damage, caused by pieces of material deposited on the surface of the abrasive article.

SUMMARY

The disclosure proceeds from an abrasive article, in particular a coated abrasive article, having a plurality of holes for extracting abrasive dust from a machining surface during an abrasive process on the work surface. The plurality of holes is arranged in a hole pattern, wherein a hole density decreases from an inner region of the hole pattern to an outer region of the hole pattern. According to the disclosure, at least one hole in the hole pattern is formed as an elongated hole.

The abrasive article is, in particular, a coated abrasive article ("coated abrasive"), in one realization a coated abrasive disk. The abrasive article includes a support with at least one layer, in particular produced from paper, cardboard, vulcanized fiber, foam, a plastics material, a textile structure, in particular woven fabric, knitted fabric, crocheted fabric, braiding, non-woven material or a combination of said materials, in particular paper and a woven fabric, in one or multiple layers. The, in particular, flexible, support serves as a carrier layer and gives the abrasive article specific characteristics with regard to adhesion, expansion, breaking and tensile strength, flexibility and stability. Abrasive grit is applied and fixed to the carrier layer. In the case of a coated abrasive article, abrasive grit adheres, for example, on account of a base coat to the, in particular flexible, support. The grit is pre-fixed in the desired position, in particular, and with the desired distribution on the support. The expert is sufficiently familiar with suitable base coats for the application of grit on a support from the prior art. Artificial resins, such as, for example, phenol resin, epoxy resin, urea resin, melamine resin, polyester resin or the like can be considered as base coats. In addition to the base coats, the abrasive article can comprise at least one top coat, for example also multiple top coats. The top coat or coats are applied, in particular, in layers on the base coat and the grit. In this case, the top coat or coats connect the grains of grit fixedly together and fixedly to the support. The expert is sufficiently familiar with suitable top coats from the prior art. Artificial resins, such as, for example, phenol resin, epoxy resin, urea resin, melamine resin, polyester resin can be considered as top coats. Furthermore, further binding agents and/or additives can be provided in order to lend specific characteristics to the abrasive article. Such binding agents and/or additives are familiar to the expert.

Alternative abrasive articles, such as, for example, bonded abrasive articles ("bonded abrasives") are also conceivable. Bonded abrasive articles are, in particular, resin bonded cutting and grinding disks which are familiar to the expert. For resin bonded cutting and grinding disks, a mass is mixed from abrasive minerals and fillers, powdered resin and liquid resin, said mass then being pressed to form cutting and grinding disks with various strengths and diameters.

The abrasive article can be present in various, in principle arbitrary, manufacturing forms, for example as an abrasive disk or as an abrasive belt, as an arch, paper, roll or strip. Typically, the form of the abrasive article is predefined by an intended abrasive process (for example for use in a belt grinding device). In a realization, the abrasive article is realized as an abrasive disk. An "abrasive disk" is to be understood, in particular, as a unit of the abrasive article which forms the tool of an abrasive device (also: grinding machine), in particular of a rotary sander or a disk-type sander or an orbital sander and, when such a machine is operating, is in direct contact with a machining surface of a workpiece for removing material. The abrasive disk can be realized in a substantially planar manner, i.e. flatly. In principle, arbitrary sizes of abrasive disks are possible, including typical standard sizes of abrasive disks, for example within the range of between 5 cm and 50 cm. In one embodiment, the abrasive article is realized as a circular abrasive disk with a diameter of 15 cm. The technical teaching underlying the present disclosure is transferrable to arbitrary sizes and geometries of abrasive articles, in particular of abrasive disks. An abrasive disk is provided, in particular, for the purpose of being connected reversibly releasably to an abrasive plate of an abrasive instrument. An "abrasive plate" is to be understood in this context, in particular, as a unit of an abrasive instrument, for example of a disk-type sander or of an orbital sander which is provided for the purpose of receiving an abrasive article, in particular an abrasive disk. The abrasive plate preferably comprises at least one substantially level surface which serves as the receiving surface for the tool (the abrasive article). With the abrasive instrument in the activated state, the abrasive plate together with the abrasive article fastened thereon, in particular together with the abrasive disk fastened thereon, is driven, in particular moved, by the abrasive instrument.

The size and form of the abrasive article determine the maximum surface area of the abrasive article available as abrasive surface (i.e. without deducting surface portions which are created by holes in the abrasive article). A circular abrasive disk with a diameter of 15 cm, for example, comprises a maximum surface area available as abrasive surface of 176.7 $cm^2$. Each hole made in the abrasive article reduces said surface area available as abrasive surface by the corresponding surface area assumed by the hole.

The abrasive article comprises a plurality of holes, i.e. perforations or apertures which serve for the extraction of material abrasion generated on a machining surface during the abrasive process, in particular abrasive dust or other material, by means or an extraction device of the abrasive instrument. A "hole" is to be understood, in this case, as an opening or a recess in the abrasive article which penetrates the abrasive article fully, i.e. which extends through the support and the coating located thereon, in particular in the direction substantially perpendicular to the surface of the abrasive article. The term "hole" is to be understood in this document as any type or hole, irrespective of a geometrical realization. In particular, the term "hole" consequently includes both a circular hole and a substantially round hole. A "substantially round hole", in this case, can be realized as a polygonal hole, in particular a triangular, quadrangular, in particular rectangular or square-shaped, star-shaped, polygonal, in particular isogonic, or part angular and part curved hole. In addition, the form of the hole can also be selected in another manner from regular or irregular, in particular polygonal, forms. In this case, the envelope of the geometric figure approaches a circle. In particular, a circular and a substantially round hole can be describable by at least one radius $r_L$. A circular hole or a substantially round hole can comprise a radius $r_L$ which is within the range of approximately between 0.25% and approximately 5% of the longest dimension of the abrasive article, in particular within the range of between 0.5% and 1.5% of the longest dimension of the abrasive article. In the exemplary embodiment of an abrasive disk, the diameter of the abrasive disk provides the longest dimension of the abrasive disk. In particular, a substantially round hole can comprise a radius $r_L$ which is within the range of between 0.375 mm. and approximately 7.5 mm, in particular within the range of 0.75 mm and 2.25 mm. In an exemplary embodiment, a substantially round hole or a circular hole comprises a radius $r_L$ of 1.0 mm, of 1.2 mm or of 1.5 mm.

According to the disclosure, at least one hole in the hole pattern is formed as an elongated hole. An elongated hole, in this case, comprises an oblong or elongated shape compared to a substantially round hole or a circular hole. In particular, an elongated hole can be describable by at least one radius $r_{LL}$ and one length $l_{LL}$. In addition, an elongated hole can define an axis which is given by the direction of the elongation (i.e. in the direction of extension of the length $l_{LL}$). An elongated hole can comprise a length $l_{LL}$ which is within the range of between approximately 2% and approximately 13% of the longest dimension of the abrasive article, in particular within the range of between 2.5% and 6.5%. In particular, an elongated hole can comprise a length $l_{LL}$ which is within the range of between 3 mm and approximately 20 mm, in particular within the range of between 4 mm and 10 mm. In an exemplary embodiment, an elongated hole comprises a length $l_{LL}$ of 4 mm, 5 mm or 6 mm. An elongated hole can comprise a radius $r_{LL}$ which is within the range of between approximately 0.25% and approximately 5% of the longest dimension of the abrasive article, in particular within the range of between 0.5% and 1.5%. In particular, an elongated hole can comprise a radius $r_{LL}$ which is within the range of between 0.375 mm and approximately 7.5 mm, in particularly within the range of 0.75 mm and 2.25 mm. In an exemplary embodiment, an elongated hole comprises a radius $r_{LL}$ of 1.0 mm, of 1.2 mm or of 1.5 mm.

In addition, an elongated hole can also comprise, in principle, a form which is chosen from polygons or elongated ellipsoids or arches. For example, an elongated hole can also be describable by a (non-square-shaped, i.e. elongated) rectangle with a width $b_{LL}$ and a length $l_{LL}$. A rectangular elongated hole can comprise a length $l_{LL}$ which is within the range of between approximately 2% and approximately 13% of the longest dimension of the abrasive article, in particular within the range of between 2.5% and 6.5%. In particular, an elongated hole can comprise a length $l_{LL}$ which is within the range of between 3 mm and approximately 20 mm, in particular within the range of between 4 mm and 10 mm. In an exemplary embodiment, a rectangular elongated hole comprises a length $l_{LL}$ of 5 mm. A rectangular elongated hole can comprise a width $b_{LL}$ which is within the range of between approximately 0.5% and approximately 10% of the longest dimension of the abrasive article, in particular within the range of between 1.0% and 3.0%. In particular, a rectangular hole can comprise a width $b_{LL}$ which is within the range of between 0.75 mm and approximately 15 mm, in particularly with the range of 1.5 mm and 4.5 mm. In an exemplary embodiment, an elongated hole comprises a width $b_{LL}$ of 2.0 mm, of 2.4 mm or of 3.0 mm.

It must be pointed out that an elongated hole does not provide a cut, as is known in the prior art. Such cuts cannot be specified by a width $b_{LL}$ or by a radius $r_{LL}$ as they are generated simply by a cut in the abrasive article ($b_{LL}=r_{LL}=0$ mm applies correspondingly). In particular, such cuts do not comprise a surface area. In addition, such cuts have a fundamentally other effect—in particular, fluid dynamic characteristics between elongated holes according to the disclosure and said cuts are not comparable on account of the dynamic pressure required to open a cut.

The holes of the abrasive article, both substantially round holes, circular holes and elongated holes, can be generated by embossing, stamping, laser cutting or combinations thereof in the carrier layer and the abrasive layer (total of the coating of the carrier layer). In an embodiment, the holes are stamped into the abrasive article. In a further embodiment, the holes are cut, in particular burnt, into the abrasive article by means of a laser beam.

"A plurality of holes" is to be understood as more than holes, in particular more than 40 holes, quite especially more than 50 holes. In an embodiment, an abrasive article realized as an abrasive disk comprises a hole pattern with at least approximately 20, in particular at least approximately 50, quite especially at least approximately 80 holes. In a further embodiment, the number of holes is not greater than approximately 300, in particular not greater than approximately 200, quite especially not greater than approximately 150. The plurality of holes, in this case, is arranged in a hole pattern. In an embodiment, the totality of the holes provided. in the abrasive article is arranged. In a hole pattern, i.e. the hole pattern consists of the totality of the holes of the abrasive article. In an alternative embodiment, at least 50% of the holes form the plurality of holes which are arranged in a hole pattern. As an alternative to this, at least 70% of the holes form the plurality of holes which are arranged in a hole pattern. As an alternative to this, at least 90% of the holes form the plurality of holes which are arranged in a hole pattern.

The hole pattern can cover the entire abrasive article (i.e. can be distributed over said article), can cover the entire abrasive article substantially (i.e. more than 50% but less than 100%), can cover multiple parts of the abrasive article or can cover only part of the abrasive article. A measurement for the degree of coverage of the abrasive article by the hole pattern can be given, in this case, for example, over the surface of the abrasive article covered by an envelope of the hole pattern. Thus, "cover the entire abrasive article" means that the envelope of the hole pattern covers the entire surface of the abrasive article, the surface area of the envelope and the surface area of the abrasive article being the same. In an exemplary embodiment of an abrasive article as an abrasive disk, the hole pattern can be enclosed, for example, by an envelope in circular form. If the envelope then comprises a radius which is the same as the radius of the abrasive disk, the hole pattern thus covers the entire abrasive article. If the radius of the envelope is slightly smaller than the radius of the abrasive disk, the hole pattern thus covers substantially the entire abrasive article (i.e. more than 50% but less than 100%, in a preferred manner more than 70% but less than 100%, in a particularly preferred manner more than 85% but less than 100%). In particular, an abrasive article can be realized in such a manner that an edge of an outermost hole of the hole pattern intersects the edge of the abrasive article. As an alternative to this, an abrasive article can also be realized in such a manner that an edge of an outermost hole of the hole pattern is at least at a measurable distance from the edge of the abrasive article. In addition, an abrasive article is conceivable where the hole pattern covers only part of the surface, i.e. a spatially delimited surface portion, of the abrasive article. The "envelope" is to be understood in particular, as a curve, for example a circle, a circular ring, a rectangle or also another geometric form which envelopes or encases the hole pattern.

"Cover multiple parts of the abrasive article" can be understood correspondingly in that the hole pattern is certainly describable by an envelope but in said envelope regions exist which are then not penetrated by holes of the hole pattern. It is, in particular conceivable for the hole pattern to cover multiple parts of the surface of the abrasive article which are spaced apart from one another, i.e. it is arranged distributed in such a manner over the abrasive article that regions which do not comprise holes are realized between regions which do comprise holes. In particular, said spaced distribution can be realized in a uniform or homogeneous manner.

The number and the surface area of the holes determine the surface area of the abrasive article actually (not: maximally (available as abrasive surface—this corresponds to the maximally available surface area (see above) minus the surface area formed by the totality of holes. The surface area of the abrasive article actually available as abrasive surface determines the abrasive characteristics of the abrasive article in a significant manner, in particular the amount of a material removed from a machining surface during an abrasive process. The amount of material removed is typically increased as the surface area of the abrasive article available as abrasive surface increases. In addition, the number and the surface area of the holes influence an extraction behavior during extraction of abrasive dust from the intermediate region between abrasive article surface and machining surface during an abrasive process on the machining surface. In particular, a tendency for the removed material, in particular abrasive dust, to collect on the surface of the abrasive article increases as the surface area available as abrasive surface increases.

A number of holes and the total size thereof define a surface area $A_L$ of the corresponding holes. With reference to a surface $A_s$ of the abrasive article on which the holes are arranged, a hole density $p=A_L/A_s$ can consequently be defined. In particular, a "hole density of an entire hole pattern" of the abrasive article can be defined as a ratio between $A_L$ of the corresponding holes of the entire hole pattern and the entire surface $A_s$ of the abrasive article. Further hole densities can additionally be defined. According to the disclosure, the hole pattern, in particular of the abrasive article, divides into an inner region and an outer region, the hole density $p_i$ ($p_i=A_{L.inner}/A_{S.inner}$) of the inner region of the hole pattern decreases toward the hole density $p_A$ ($p_A=A_{L.outer}/A_{S.outer}$) of the outer region of the hole pattern. $P_i>P_A$ applies.

The hole pattern—and in particular also the abrasive article when the hole pattern covers the entire abrasive article substantially—is divided into at least an inner region and an outer region, the outer region completely surrounding the inner region. The inner region and the outer region are definable, for example, as separate regions via geometric forms, the geometric form which describes the outer region completely surrounding the geometric form which describes the inner region. In particular, the inner region and the outer region connect directly to one another so that typically geometric sizes of the inner region form, as it were, geometric sizes of the outer region. In an embodiment of the abrasive article as a substantially circular abrasive disk, the inner region and the outer region can be arranged concentrically to one another. In addition, the inner region and the outer region can be arranged concentrically to the center (geometric center point or center of gravity) of the hole pattern. In particular, the inner region can provide a circular disk with radius $R_{inner}$, whilst the outer region provides a circular ring which directly adjoins the inner region and the smaller radius of which corresponds to $R_{inner}$ and the larger radius $R_{outer}$ of which corresponds to the diameter of the hole pattern, in particular to the diameter of the envelope of the hole pattern, quite particularly to the diameter of the abrasive disk. In particular, the radius $R_{outer}$ can be twice radius $R_{inner}$, quite particularly three times $R_{inner}$. Thus, for example, a substantially circular abrasive disk of 15 cm diameter can comprise an inner region with a radius $R_{inner}$ of 3.75 cm (surface $A_{S.inner}$=44.2 $cm^2$) and an outer region with a smaller radius $R_{inner}$ of 3.75 cm and a larger radius $R_{outer}$ of 7.5 cm (surface $A_{s.outer}$=132.5 $cm^2$), (at an overall surface of the abrasive disk of surface $A_{s.overall}$=176.7 $cm^2$). Both the inner region and the outer region each comprise at least one hole so that a hole density for the inner region and the outer region can be specified. According to the invention disclosure, the hole density of the outer region is chosen to be smaller than the hole density of the inner region.

As an alternative to this or in addition to it, the inner region and the outer region can also be defined by a ratio between the surface area of the outer region and the surface area of the inner region. In the above-named exemplary embodiment of the abrasive article in the form of an abrasive disk, where the inner region provides a circular disk with radius $R_{inner}$ whilst the outer region provides a circular ring directly adjoining the inner region with a greater (outer) radius $R_{outer}$, a ratio of corresponding surface areas can be, for example, 2:1, in particular can be 3:1, quite especially can be 4:1, 8:1 or 15:1. In addition, it is also conceivable to define the inner region and the outer region by their hole densities, the hole density of the inner region differing, in an advantageous manner, dramatically from the hole density of the outer region. For example, an inner region can comprise a uniform distribution of holes with a hole density of 8%, whilst the outer region comprises a uniform distribution of holes with a hole density of 3%. The dramatic difference in the hole density can be seen immediately on the abrasive article and can be clearly differentiated by a border between inner region and outer region. Consequently, inner region and outer region are clearly detached and defined from one another.

In the event of a non-circular abrasive article, corresponding inner region and outer region are definable analogously. Thus, for example, a substantially rectangular abrasive article can comprise an inner region in the form of an "inner rectangle" and an outer region in the form of an "outer rectangle", the "outer rectangle" completely surrounding the "inner rectangle". It is conceivable in the case of an abrasive belt for the belt-shaped abrasive article to comprise an inner region in the form of an "inner strip" and an outer region in the form of two "outer strips", the two "outer strips" completely surrounding the "inner strip".

Having consideration to the surface area actually available as abrasive surface, to the overall surface available for dust extraction, to the position of the holes available on the abrasive article for dust extraction and the bearing thereof for moving the abrasive article during an abrasive process, it appears according to current knowledge of the present invention disclosure, that a relatively high hole density of the inner region, compared to the hole density in the outer region, has a particularly advantageous effect on the abrasive characteristics of the abrasive article, in particular the abrasive disk. The abrasive article's capability to extract dust can be significantly improved in contrast to abrasive articles of the prior art.

Said approach according to the disclosure is contrary to previous approaches for maximizing the amount of extracted abrasive dust which have been aimed purely to introduce as many holes as possible into the abrasive article in order to increase the hole surface available for extraction in relation to the surface of the abrasive article available as abrasive surface. The plurality of small holes of the abrasive article known in the prior art, however, often result in problems with a mechanical and/or structural stability of the abrasive article. In particular in regions of an abrasive article in which many small holes are present—typically accumulated against the edge of the abrasive article in the prior art—there is often a significantly increased tendency for the abrasive article to tear. Tearing occurs, in this case, as a result of physical forces such as shear forces, torsion forces or the like which act on the abrasive article as a result of a rotational movement, eccentric movement and/or orbital movement. In addition, the plurality of small holes in the abrasive articles known in the prior art result in an apparently disadvantageous increase in hole density, where, from a certain ratio between holes and the surface of the abrasive article available as abrasive surface, material removing action and service life of the abrasive article decrease drastically.

The proposed approach according to the disclosure, in contrast, is able to overcome such disadvantages of the prior art. According to present knowledge, in this case, a comparatively high hole density in the inner region of the abrasive article—compared to a hole density of the outer region of the abrasive article (not repeated again and again below)—leads to advantageous fluid dynamic characteristics between the abrasive article and the machining surface. It is assumed that the high hole density in the inner region of the abrasive article leads to a more uniform, in particular more laminar and more turbulence-free, flow progression of drawn-in air so that material entrained ("transported") with the air flow, such as abrasive dust, is moved or guided in a more uniform manner and consequently is able to be removed from the region between machining surface and abrasive article in a more reliable manner. In other words, such a high hole density in the inner region of the abrasive article results in a reduction of a "nozzle effect", the nozzle effect designating an increase in air speed in relation to an undisturbed air flow which is produced by a constriction in the flow cross section (an associated pushing of flow lines leading to an increase in speed).

It is assumed that the distribution of higher hole density in the inner region to lower hole density in the outer region correlates directly with the rotational speed of the abrasive article in the case of a typical application with a disk-type sander or an orbital sander. It has thus been found that a high speed of rotation of the holes in the outer region of the abrasive article, in particular of the abrasive disk, is combinable advantageously with a low hole density in the outer region. Said effect can possibly also be explained with reference to a (comparative) acceleration of the air flow in the outer region of the abrasive article due to the comparatively low hole density (nozzle effect). As a result of an increase in the hole density in the inner region, the air flowing radially from outside to the center of the abrasive disk in the inner region of the abrasive article can obviously be reduced so that the air flow (i.e. air pressure or also flow suction) in the outer region of the abrasive article can be advantageously increased by the holes situated in the outer region. As a result, the suction capacity can be increased, which, in spite of the comparatively higher speed of rotation in the outer region, results in particularly good characteristics in the removal of the abraded material, in particular of the abrasive dust to be extracted, and consequently in the abrasion result. Consequently, the realization according to the disclosure of an abrasive article allows the impact of the nozzle effect in the inner region of the hole pattern, in particular of the abrasive article, to be advantageously reduced, whilst the impact of the nozzle effect in the outer region of the hole pattern, in particular of the abrasive article, is advantageously increased.

It must be pointed out that the advantageous, comparatively high hole density in the inner region of the hole pattern can be realized in a sturdy manner only by introducing elongated holes, in particular in the inner region of the hole pattern. As a result of the use according to the disclosure of the elongated holes, a number of comparatively thin connecting struts between individual adjacent holes (which would be present abundantly in the case of the desired high hole density) can be reduced and consequently tearing of the abrasive article—in particular as a result of the abrasive process—can be prevented. By using elongated holes and/or correspondingly wide connecting struts—which are realized rather as connecting surfaces—shear forces, torsion forces and transverse forces acting during an abrasive process can consequently be better taken up and absorbed on account of the abrasive article having a more sturdy geometry overall. In particular, it is consequently possible to provide a particularly sturdy abrasive article with said advantageous characteristics. Consequently, in an advantageous manner, the long-term stability of the abrasive article realized with elongated holes can be significantly increased compared to abrasive articles without elongated holes—in particular with an increased number of individual holes.

In addition, it is assumed that the relatively large-area extraction surface omitted as a consequence of the large hole density (in particular in the case of abrasive articles known in the prior art) results, in the inner region of the abrasive article, in a less point-related and consequently more uniformly distributed or more homogeneous extraction in particular in the inner region. In other words, an elongated hole can bring about a "collective effect" on account of its geometric extension. Said effect is strengthened by the already mentioned (suspected) more laminar and more turbulence-free flow progression of drawn-in air in the inner region of the abrasive article.

In an embodiment, the hole density in the inner region of the hole pattern is between 7.5% and 16.0%, in particular between 8.5% and 13.0%, quite particularly between 9.0% and 12.0%. In an embodiment, the hole density in the outer region of the hole pattern is between 1.5% and 4.8%, in particular between 2.0% and 3.8%, quite particularly between 2.9% and 3.4%. The described effect occurs according to current knowledge to a particularly advantageous extent for such hole patterns which comprise a ratio of the hole density $p_1$ of the inner region to the hole density $p_A$ of the outer region which is within the range of between 1.9% and 6.9%, in particular within the range of between 2.8% and 6.0%, quite particularly within the range of between 3.1% and 5.7%.

In an embodiment, the hole density of the entire hole pattern is between 2.6% and 6.8%, in particular between 3.0% and 6.5.%, quite particularly between 3.5% and 5.5%. With a hole density of the entire hole pattern chosen in this manner combined with the previously named hole densities in the inner region and outer region of the hole pattern, in particular combined with the preferred ratios of hole density $p_i$ of the inner region to the hole density $p_A$ of the outer region, particularly good results are obtained in the abrasive effect, in particular the abrasive efficiency, long-term stability and low clogging of the abrasive surface. It must be pointed out that a sturdy realization of said high hole density in the inner region can only be provided by the introduction of the elongated holes according to the disclosure with a constant or decreasing number of holes.

In an embodiment, the number of elongated holes in an inner region of the hole pattern is greater than the number of elongated holes in an outer region of the hole pattern. The advantageous distribution according to the disclosure of the hole densities of the inner region and of the outer region can be realized in a particularly simple manner in this way. For example, a hole pattern in an inner region can comprise 24 elongated holes and in an outer region only 8 elongated holes.

In an embodiment, an elongation and/or a radius of a first elongated hole, in particular of an elongated hole in the inner region of the hole pattern, are/is different from an elongation and/or a radius of a second elongated hole, in particular of an elongated hole in the outer region of the hole pattern. In particular, an elongation and/or a radius of a first elongated hole, in particular of an elongated hole in the inner region of the hole pattern, are/is greater than an elongation and/or a radius of a second elongated hole, in particular of an elongated hole in the outer region of the hole pattern. In this way, a surface area of a hole can be influenced in a particularly simple manner and consequently the hole density in the inner region and in the outer region can be matched precisely and to obtain particularly advantageous abrasive characteristics of the abrasive article. In particular, an abrasive action and abrasive efficiency are able to be adjustable particularly finely in such a manner. In particular, an abrasive article is conceivable, for example, which comprises elongated holes both in the inner region and in the outer region, an elongation of the elongated holes decreasing from the inner region toward the outer region and/or a radius of the elongated holes decreasing from the inner region toward the outer region. In addition, the mechanical characteristics of the abrasive article can be adjusted in an advantageous manner, in particular can be adjusted variably over the abrasive article, so that a particular tear resistance of the abrasive article can be achieved.

In an embodiment of the abrasive article, the hole pattern is a symmetrical hole pattern, in particular a rotationally symmetrical and/or rotary symmetrical and/or axially symmetrical and/or point symmetrical and/or translation symmetrical hole pattern. Consequently, the hole pattern comprises the characteristic of being imaged on itself, by applying a corresponding symmetry image or symmetry operation, i.e. by corresponding rotation and/or turning and/or mirroring and/or translation or the like. Examples of such symmetrical hole patterns can provide regular patterns (holes arranged in rows and columns), radial patterns (holes arranged in radial rays about a central point), spiral patterns (holes arranged in spirals), repeatedly arranged curved patterns (holes arranged in curved shaped) or the like. A symmetrical hole pattern can be produced in a particularly simple manner. In addition, symmetrical hole patterns can be mounted on an abrasive plate in a particularly simple manner on account of their plurality with regard to the symmetry present as it is possible to align the abrasive article in relation to the abrasive plate using little effort.

In an alternative embodiment of the abrasive article, the hole pattern is an asymmetrical hole pattern, in particular a rotationally asymmetrical and/or rotary asymmetrical and/or axially asymmetrical and/or point-asymmetrical and or translation asymmetrical hole pattern. In particular, hole patterns, which comprise a controlled irregularly shaped distribution and consequently comprise a corresponding asymmetry, are also conceivable. A "controlled irregularly shaped distribution" is to be understood, in particular, as the hole pattern comprising an arrangement which is created in a targeted manner, is in particular calculated or is unambiguously predefined in another manner—and is consequently reproducible but is nevertheless asymmetric. For example, the arrangement which is created in a targeted manner can be a mirror asymmetry, a rotational asymmetry, a rotary asymmetry, a translation asymmetry or combinations thereof. In an exemplary embodiment, a targeted irregularly shaped distribution can be provided by realizing a spiral-shaped hole pattern where holes are arranged in such a manner that full rotational asymmetry results—i.e. the hole pattern is only repeated once with rotation about 360° (congruency only with rotation about 360°). In particular, rotational asymmetry relates to asymmetry with rotation about the center—defined as the geometric center point or as the center of gravity. In an embodiment of the abrasive article, all holes of the hole pattern belong to the arrangement which is created in a targeted manner, is in particular calculated or is unambiguously predefined in another manner but is nevertheless asymmetric. As an alternative to this, only parts of the hole pattern can also belong to the arrangement which is created in a targeted manner, is in particular calculated or is unambiguously predefined in another manner but is nevertheless asymmetric. For example, it can be provided that a large part of the holes of the hole pattern belong to the arrangement which is created in a targeted manner, is in particular calculated or is unambiguously predefined in another manner but is nevertheless asymmetric. A "large part of the holes" is to be understood in this context, in particular, as at least more than 50%, preferably at least more than 70% and in a particularly preferred manner at least more than 90% of the holes. In an embodiment, the hole pattern comprises an arrangement which is created in a targeted manner, is in particular calculated or is unambiguously predefined in another manner but is nevertheless asymmetric over at least 20 holes, in particular over at least 40 holes, quite particularly over at least 60 holes. An abrasive article where rotational asymmetry extends up to at least 51%, at least 70% or at least 85% of the holes of the hole pattern is conceivable.

Asymmetrical distribution of the hole pattern strengthens the effects underlying the disclosure of a particularly advantageous extraction once again. On account of the asymmetrical distribution of the holes in the hole pattern, there are fewer shadowing effects of the (in particular adjacent) holes amongst one another in a typical application with a disk-type sander or an orbital sander. In particular, the asymmetrical distribution can result in a very uniform and homogeneous hole distribution over the abrasive article so that regions which do not comprise holes are dimensioned in a similar manner over the entire abrasive article. In addition, with reference to the typical rotational movements and/or orbital movements when using a disk-type sander or an orbital sander, deviations from a symmetrical distribution are advantageous by holes located further outside not significantly preventing or disturbing an air flow to a hole located further inside, i.e. shadowing the inside hole. Consequently, an air flow to all holes distributed on the abrasive article can be ensured so that advantageous extraction of removed material, in particular abrasive dust, is possible over the entire surface of the abrasive article.

It has been found, furthermore, that the distribution of holes in an asymmetrical hole pattern results in that, in the case of a typical rotational movement and/or orbital movements of the abrasive article, as occur when using a disk-type sander or an orbital sander, the part surface of the machining surface, which is passed over by at least one hole of the abrasive article during a full revolution of the abrasive article, is greater compared to an abrasive article with a symmetrical hole pattern—with comparable hole density and hole number. In particular, in the case of an asymmetrical hole pattern, no repeated passages are made by multiple holes as is the case with symmetrical hole patterns. Consequently, an asymmetrical hole pattern allows for a more uniform extraction over the machining surface of removed material, in particular abrasive dust.

In an embodiment of the abrasive article, the hole pattern describes at least one spiral line, in a preferred manner a plurality of spiral lines, wherein holes of the hole pattern are arranged along the spiral line (spiral lines). A "spiral line or spiral lines" is to be understood here as a curve or a quantity of curves which proceeds/proceed from at least one central point (start point) on the abrasive article and turning about the at least one central point is/are distanced from said central point. In particular, a distance from points of the line to the spiral axis is modified strictly monotonically to the angle. In particular, an image of differentiable in a polar coordinate system. In this case, the central point can be arranged with the or in the vicinity of the center of the abrasive article or, as an alternative to this, can be situated at a distance from the center of the abrasive article. In particular, multiple spiral lines ("spirals" and "spiral lines" are to be understood synonymously below) can also proceed from different central points or can proceed from one common central point. In particular, hole patterns are conceivable which describe at least one Archimedes spiral line, one Euler's spiral line, one Cornu's spiral line, one clothoid, one Fermat's spiral line, one hyperbolic spiral line, one auger spiral line, one logarithmic spiral line, one Fibonacci spiral line, one golden spiral line (or spiral lines) or combinations thereof. In an embodiment of the abrasive article, the hole pattern describes at least one further spiral line which is aligned in the opposite direction to at least one spiral line, in a preferred manner a plurality of further spiral lines which are aligned in the opposite direction to at least one spiral line, arranged along the holes of the hole pattern. In particular, all holes of the hole pattern can be arranged along the at least one spiral line and the at least one spiral line aligned in the opposite direction. In particular, the at least two spiral lines can be in opposite directions to one another with reference to a spiral axis of the spiral lines. "In opposite directions" is to be understood in this context, in particular, as the spiral lines extending in opposite directions about their spiral axes away from or toward the respective central points (start points).

By using at least one spiral line, in particular by using a plurality of spiral lines, in a preferred manner by using oppositely aligned spiral lines, a particularly advantageous distribution of the holes on the abrasive article can be achieved. In one embodiment, the opposing spiral lines differ as to their number. This is to be understood, in particular, as a number of spiral lines which extend in one direction differing from the number of spiral lines which are in the opposite direction to said spiral lines. In particular, it can be achieved in this way that an asymmetrical hole pattern with advantageous surface utilization and advantageous surface distribution is achieved. In an embodiment, the number (m) of spiral lines which run in one direction and the number (n) of spiral lines which are in the opposite direction to said spiral lines, correspond to Fibonacci numbers or multiples of Fibonacci numbers. In an embodiment as an example, the numbers comprise the following values for (m, n): (3, 5), (5, 8), (8, 13), (13, 21), (21, 34), (34, 55), (55, 89), (89, 144) or multiples of said values. The achievement of such a design of the hole pattern is that the holes of the hole pattern are distributed uniformly over the surface of the abrasive article, it being possible at the same time to prevent the holes from lying directly behind one another in the radial direction (shadowing effect in the case of dust extraction). In an embodiment of the abrasive article, the at least one spiral line and the at least one further spiral line aligned in the opposite direction intersect at least once. In addition, where there are multiple spiral lines aligned in opposite directions, multiple intersection points can also result. In this way, it can be realized in a particularly simple manner that a high hole density is applied which decreases according to the disclosure from an inner region to an outer region of the hole pattern.

"Arranged along a spiral line" or generally also "arranged according to a hole pattern" is to be understood as the position of the holes being describable substantially by a corresponding geometric figure of the hole pattern (e.g. a spiral). "Substantially" is to be understood in this context, in particular, as a distance from a predefined (ideal) position being, in particular, less than 100%, preferably less than 50% and in a particularly preferred manner less than 25% of a diameter of a corresponding hole.

In particular, all holes of the hole pattern can be arranged along the at least one spiral line, in a preferred manner along the plurality of spiral lines. In this way, a particularly advantageous, uniform distribution of the holes over the abrasive article can be achieved. It is conceivable, in particular, for the distances of each of two holes, which follow one another directly along a spiral line, to vary by less than 60%, in a particularly preferred manner by less than 50%, from the largest distance between two consecutive holes. As a result, a particularly favorable and uniform distribution of the holes can be achieved.

In one embodiment, the at least one spiral line is simply described by holes of the inner region or of the outer region. As an alternative to this, the at least one spiral line is described by holes of the inner region and of the outer region. In an embodiment as an example, the hole pattern describes at least four spiral lines, in particular at least eight spiral lines, quite particularly at least sixteen spiral lines.

In an embodiment of the abrasive article, in each case at least three holes, in a preferred manner in each case at least five holes, in a particularly preferred manner in each case at least seven holes, are arranged along a spiral line. In this way, a particularly homogeneous distribution of the holes over the abrasive article can be achieved and, consequently, extraction efficiency and extraction effectiveness can be increased. In particular, the holes arranged along a spiral line are arranged equidistantly or at distances which increase toward the outside. In an embodiment of the abrasive article, in each case at least one elongated hole, in a preferred manner in each case at least two elongated holes, in a particularly preferred manner in each case at least three elongated holes, are arranged along a spiral line. The extraction efficiency and extraction effectiveness can be increased again in this manner, in particular when the elongated holes are arranged in the inner region of the hole pattern.

In an embodiment of the abrasive article a respective elongated hole is arranged aligned in such a manner along a spiral line that an axis defined by the elongation of the elongated hole extends substantially tangentially to the spiral line. "Substantially tangentially" is to be understood, in particular, as a deviation of the alignment being less than 10°, in a preferred manner less than 5°. In addition, an elongated hole can also be arranged slightly offset in parallel to the spiral line, the axis of the elongated hole extending parallel to the tangent to the spiral line. Such a hole pattern is adapted in a particularly advantageous manner to a typical movement of the abrasive article during a typical rotational movement and/or orbital movement of the abrasive article, as occurs when used width a disk-type sander or an orbital sander. In addition, it has been found that mechanical stability and kinematic stability of the abrasive article can be increased in this way during an abrasive process. The abrasive article tearing and vibrations which are caused by a slight "fluttering" of the abrasive article (probably caused by air turbulence) can be reduced in an advantageous manner.

It is assumed that the flow dynamic characteristics of the abrasive article brings about corresponding effects during an abrasive process as a result of the arrangement of the elongated holes, where an axis defined by the elongation of the elongated hole forms substantially a tangent to a corresponding spiral line.

In an embodiment of the abrasive article, the hole pattern comprises a center hole, wherein a tangent to the center hole forms a tangent, as it were, to the at least one spiral line and/or in each case a tangent to the center hole forms, as it were, a tangent to in each case one of the plurality of spiral lines. By using the center hole, the hole density can also be increased further in the inner region of the hole pattern. In addition, an alignment of the abrasive article with reference to an abrasive plate can be simplified in the case of an arrangement on an abrasive plate, as the abrasive article can be moved into alignment with a marking located on the abrasive plate, for example a central bore or a central screw of the abrasive plate. In addition, the abrasive characteristics are improved when the at least one spiral line and/or the at least one further spiral line comprise a tangent which forms, as it were, a tangent to the center hole. It is assumed that such an eccentric spiral line, which extends tangentially to the center hole, additionally increases the hole density in the inner region—in contrast, for example, to spiral lines which would extend directly into a center hole. In addition, such a hole pattern is adapted particularly well to a rotational movement and/or orbital movement of the abrasive article, as occurs when used with a disk-type sander or an orbital sander.

BRIEF DESCRIPTION OF THE DRAWINGS

The disclosure is explained in more detail in the following description by way of the exemplary embodiments shown in the drawings. The drawings, the description and the claims include numerous features in combination. The expert will also look at the features individually in an expedient manner and combine them to form sensible further combinations. Identical reference symbols in the figures designate identical elements.

The drawings are as follows.

DETAILED DESCRIPTION

Figure 1:
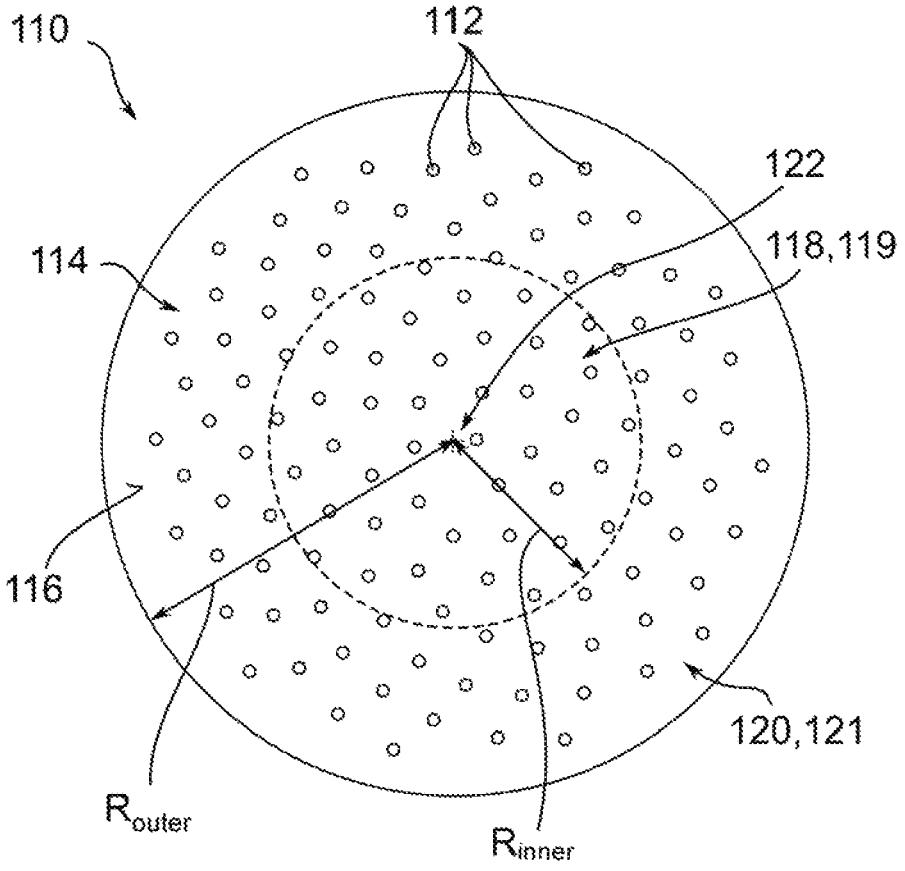
Prior art Fig. 1
FIG. 1 shows a schematic representation of an embodiment of an abrasive article according to the prior art.

FIG. 1 shows an abrasive article 110 as is known in the prior art. The abrasive article 110 is realized as a coated abrasive disk which is provided for use with a commercially available abrasive instrument 200 (for example a disk-type sander or orbital sander))—compare FIG. 2. The abrasive article 110 comprises a plurality of holes 112 which are arranged in a hole pattern 114. The holes 112 are realized as through holes which serve for the extraction of material abrasion, in particular abrasive dust or other material generated on a machining surface 202 (cf. FIG. 2), during the abrasive process by means of an extraction device of the abrasive instrument 200. The holes 112 are realized as circular, same-size holes. The holes 112 comprise a radius $r_L$ of approximately 1.2 mm. The holes 112 of the abrasive article 110 are made for example by punching or laser cutting into a previously produced abrasive article 110 which does not yet include holes 112. The abrasive article 110 shown comprises a total of one hundred and twenty holes 112, all holes 112 together forming the plurality of holes which are arranged in a hole pattern 114. The hole pattern 114, in this case, covers substantially—i.e. up to a narrow, insignificant distance from the edge (the envelope of the hole pattern, i.e. a circle enclosing the hole pattern here comprises a radius of more than $0.95 \times R_{outer}$—as a result, the hole pattern covers more than 90% of the abrasive disk and consequently substantially the entire abrasive disk) the entire abrasive article surface 116 of the abrasive article 110.

The hole pattern 114 and here also the abrasive article 110 divide into an inner region 118 and an outer region 120, the outer region 120 surrounding the inner region 118 completely. In the embodiment shown of the abrasive article 110 as a substantially circular abrasive disk, the inner region 118 and the outer region 120 are arranged concentrically to one another, the inner region 118 and the outer region 120 being arranged concentrically to the center 122 of the hole pattern 114 and of the abrasive article 110. The inner region 118, in this case, provides a circular disk 119 with radius $R_{inner}$ of 7.5 cm, whilst the outer region 120 provides a circular ring 121 which adjoins the inner region 118, the smaller radius $R_{inner}$ thereof corresponds to 7.5 cm and the greater radius $R_{outer}$ thereof corresponds to the diameter of the abrasive article 110 (i.e. the abrasive disk) of 15 cm. The inner region 118 comprises a surface area of $A_{S.inner}$=44.2 $cm^2$, whilst the outer region 120 comprises a surface area $A_{S.outer}$=132.5 $cm^2$. The overall surface of the abrasive article 110 is $A_{S.overall}$=176.7 $cm^2$. The inner region 118 comprises a total of forty-two holes 112 (with an overall hole surface of $A_{L.inner}$=1.9 $cm^2$), whilst the outer region 120 comprises a total of seventy-eight holes 112 (with an overall hole surface of $A_{L.outer}$=3.5 $cm^2$). The hole density of the outer region 120 is 2.7%, whilst the hole density of the inner region 118 is 4.3%. The hole density of the entire hole pattern is 3.1%.

Figure 2:
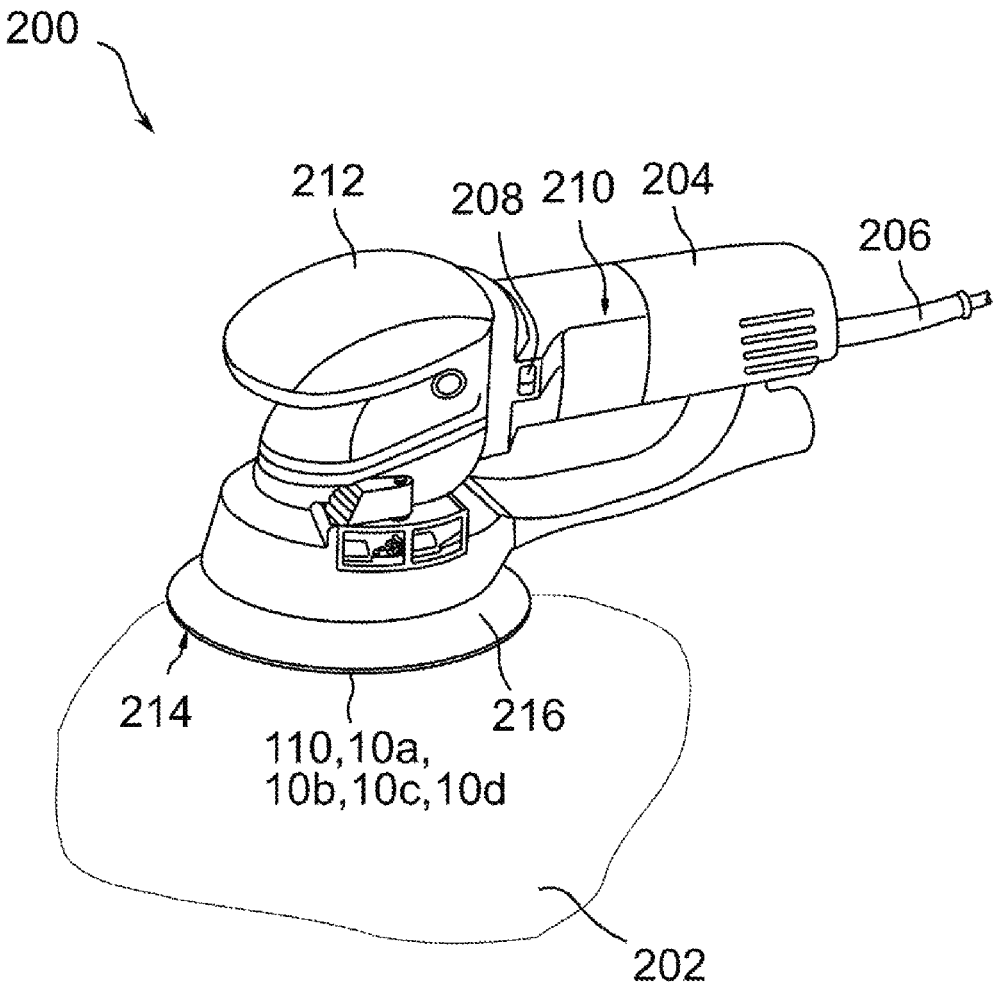
FIG. 2 shows a schematic representation of a system with an abrasive article according to the disclosure as well as an abrasive instrument and a machining surface.

FIG. 2 shows an abrasive instrument 200 formed by a disk-type or orbital sander which serves for abrasively machining a machining surface 202. The abrasive instrument 200 comprises a housing 204 which surrounds a drive unit which is not shown in any more detail and is formed by an electric motor. The drive unit is supplied with electric power in an operating state by means of a power cable 20*b* which is arranged on an end of the housing 204. As an alternative to this, the abrasive instrument can also be battery driven. A switching element 208, which is mounted in the housing 204 so as to be displaceable, is provided for activation of the drive unit. The switching element 208 is formed by a switching slider. The housing 204 forms a first, cylindrical gripping region 210 which is arranged on the end facing the power cable 206. A further gripping region 212, which is arranged on an end of the housing 204 remote from the power cable 206, is additionally provided. The further gripping region 212 is realized in a dome-shaped manner. The first gripping region 210 and the further gripping region 212 are provided for the purpose of being grasped by a hand of the operator and of guiding the abrasive instrument 200 in an operating state relatively, in particular guiding it relative to a machining surface 202. A tool receiving means 214 is arranged on the end of the abrasive instrument 200 remote from the power cable 206. The tool receiving means 214 connects to the housing 204. The tool receiving means 214 includes an abrasive plate 216. The tool receiving means 214 is provided for the purpose of receiving an abrasive article 110, 10*a-d*, in particular an abrasive disk. The abrasive article 110, 10*a-d*, in particular the abrasive disk, and the abrasive instrument 200 together form a system.

The abrasive article 110 in FIG. 1—and analogously thereto also the abrasive article 10*a-d* according to the disclosure shown below in FIGS. 4, 6 to 8—are provided for the purpose of being reversibly detachably connected to such an abrasive plate 216 of such an abrasive instrument 200. With the abrasive instrument 200 in the activated state, in this case, the abrasive plate 216 plus the abrasive article 110, 10*a-d* fastened thereon is driven by the abrasive instrument 200, in particular in a rotational movement and/or eccentric movement and/or orbital movement.

Figure 3:
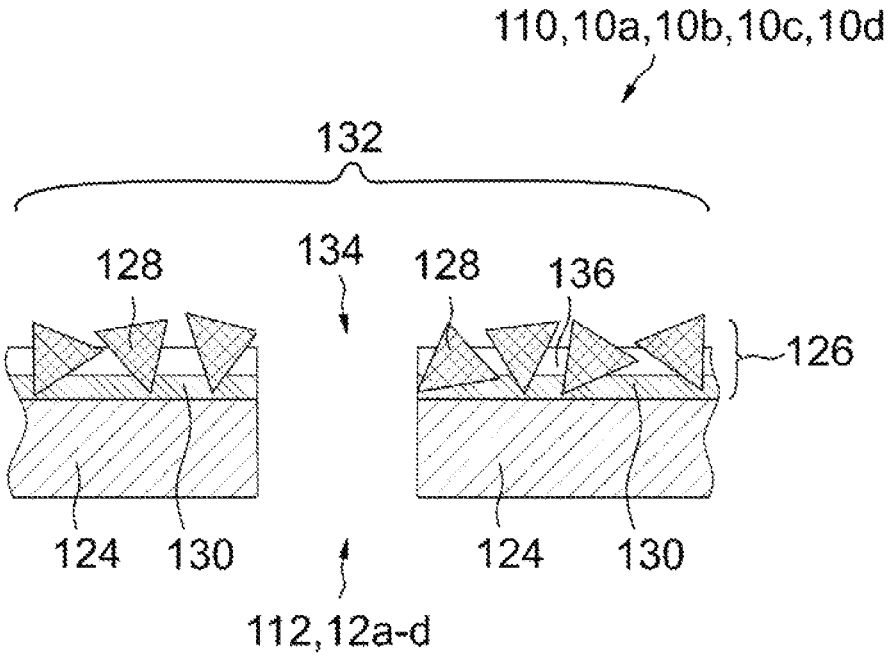
FIG. 3 shows a seriously enlarged detail from a schematic sectional representation of an embodiment of an abrasive article according to the disclosure.

As shown in FIG. 3 in a schematic, seriously enlarged sectional representation, each of the coated abrasive articles 110, 10*a-d* descried here includes a carrier element 124. In the exemplary embodiment, the carrier element 124 is formed from paper or from cardboard, as an alternative to this, for example, also from vulcanized fiber, and serves as a flexible support for the abrasive layer 126 applied thereon. The abrasive layer 126 includes abrasive grains 128 and a binding agent 130 (base binder) which connects the abrasive grains 128 and the paper or the cardboard together. The binding agent 130 can consist, for example, of a phenol resin. The abrasive layer 126 forms an abrasive surface 132 (abrasive article surface). The carrier element 124 comprises a round main extension surface (cf. FIGS. 1, and 6 to 8), the abrasive surface 132 extending parallel to the main extension surface of the carrier element 124. The carrier element 124 of the abrasive article 110, 10*a-d*, in this case, is realized in a disk-shaped manner and comprises here a diameter of 15 cm. On a side of the carrier element 124 located on the back opposite the abrasive surface 132, a receiving region is arranged which is not shown here. The receiving region includes a Velcro element which is provided for the purpose of corresponding with a Velcro element of the abrasive plate 216 of the abrasive instrument 200 and interacting with it in an adhering manner. The Velcro element is connected fixedly to the carrier element 124 of the abrasive article 110, 10*a-d* and extends parallel to the main extension surface of the carrier element 124. The holes 112, 12*a-d* made in the abrasive article 110, 10*a-d* completely penetrate the carrier element 124 and the abrasive layer 126. The holes 112, 12*a-d* penetrate the abrasive article 110, 10*a-d* substantially parallel to one another (not shown in any more detail here). The holes 112, 12*a-d* form an extraction surface parallel to the main extension surface of the carrier element 124.

The extraction surface includes the overall surface of the spaces 134 surrounded by holes 112, 12*a-d*. The holes 112, 12*a-d*, when viewed parallel to the main extension surface of the carrier element 124, form a hole pattern (cf. FIGS. 1, 4 and 6 to 8 (reference symbols 114, 14*a*, 14*b*, 14*c*, 14*d* there)), the hole pattern extending in the exemplary embodiments shown here over the entire main extension surface of the carrier element 124 of the abrasive article 110, 10*a-d*. In addition, the layer of binding agent 130 and abrasive grains 128 can also be coated with a top binder 136, for example produced from phenol resin.

The abrasive article 110 shown in FIGS. 1 and 3 and the application on the abrasive instrument 200 shown in FIG. 2 form the starting base for the following representation of exemplary embodiments of the proposed abrasive article 10*a-d* according to the disclosure which differs from the known abrasive articles 110 of the prior art by the hole pattern 14*a-d* according to the disclosure. The proposed abrasive article 10*a-d* comprises a structural design comparable in principle and serves for the same purpose or the same application as an abrasive article 110 of the prior art. The nomenclature and background information introduced within the framework of FIGS. 1 to 3 can consequently be transferred directly to the embodiments of the abrasive article 10*a-d* according to the disclosure shown as an example in each case in the following figures.

Figure 4:
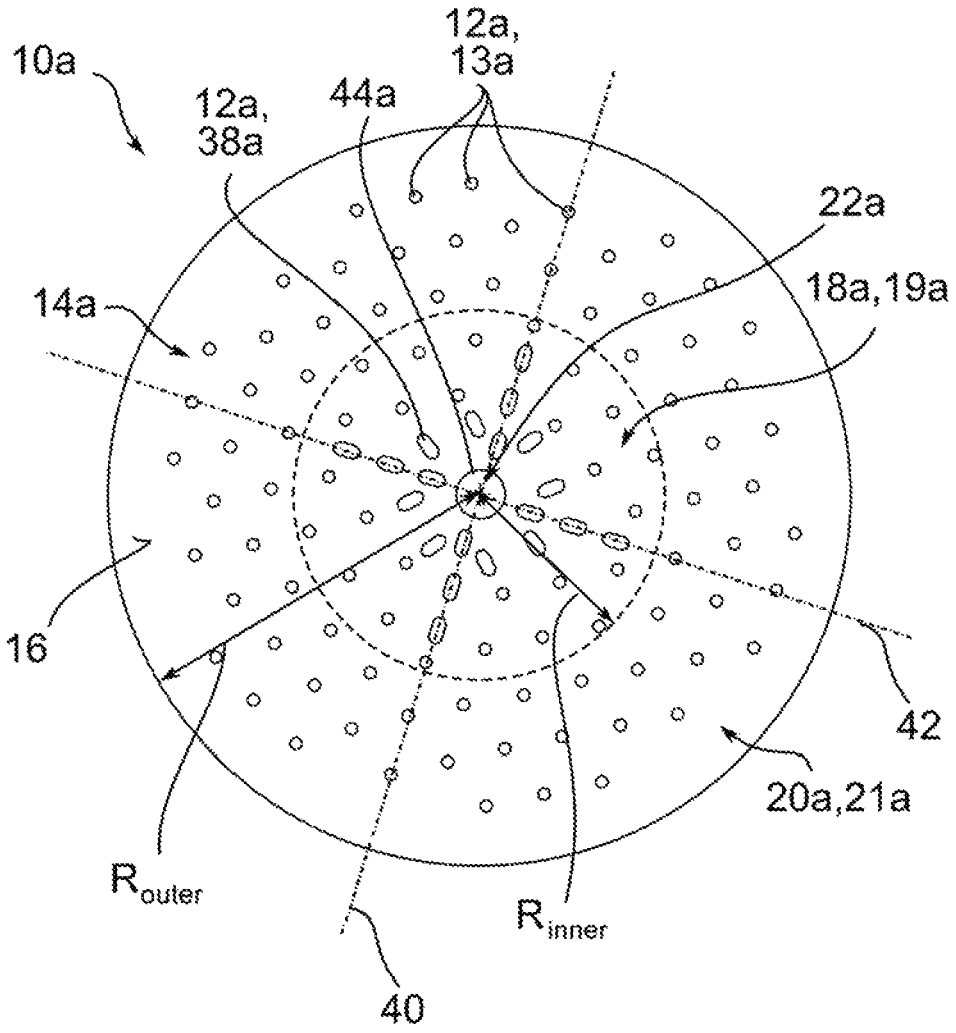
FIG. 4 shows a schematic representation of a first embodiment of an abrasive article according to the invention disclosure.

FIG. 4 shows an abrasive article 10*a* according to the disclosure in the form of a circular abrasive disk. The abrasive article 10*a* comprises a diameter of 15 cm. The abrasive article comprises a plurality of holes 12*a* for the extraction of abrasive dust from a machining surface 202 during an abrasive process on the machining surface 202. The plurality of holes 12*a* are arranged in a hole pattern 14*a*, the hole pattern 14*a* covering the entire abrasive article 10*a*— i.e. up to a narrow, insignificant distance from the edge (the envelope of the hole pattern, i.e. a circle enclosing the hole pattern, comprises here a radius of more than $0.92 \times R_{outer}$— consequently, the hole patters covers more than 85% of the abrasive disk and consequently substantially the entire abrasive disk). As already introduced in conjunction with FIG. 1, the hole patterns 14*a-d* of the abrasive article 10*a-d* described below are also divided into a respective inner region 18*a-d* and a respective outer region 20*a-d*, the outer region 20*a-d* enclosing the inner region 18*a-d* completely. The respective inner regions 18*a-d* and the respective outer regions 20*a-d* are arranged concentrically to one another and in addition concentrically to the center 22*a-d* of the hole pattern 14*a-d*. The respective inner region 18*a-d* provides, in this case, a circular disk 19*a-d* with radius $R_{inner}$ of 7.5 cm, whilst the respective outer region 20*a-d* provides a circular ring 21*a-d* adjoining the respective inner region 18*a-d*, the smaller radius $R_{Inner}$ corresponds to 7.5 cm and the greater radius $R_{outer}$ corresponds to the diameter of the abrasive article 10*a-d* (i.e. of the respective abrasive disk) of 15 cm (as explained, the edge is insignificant here).

Figure 5:
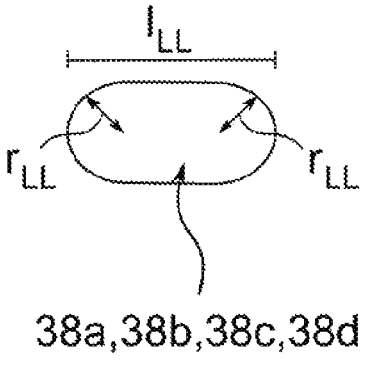
FIG. 5 shows a schematic representation of an embodiment of an elongated hole as an example.

The hole pattern comprises twenty holes 12*a* which are formed as elongated hole 38*a* and are arranged in part in a star-shaped and symmetrical manner in the inner region 18*a* of the hole pattern 14*a*. In this case, every six elongated holes 38*a* form two axes 40, 42 which are aligned perpendicularly to one another and additionally also form an axis of symmetry each of a mirror symmetry underlying the hole pattern 14*a*. In the center 22*a*, the hole pattern 14*a* comprises a center hole 44*a* which comprises a diameter of 10 mm (surface 78.5 $mm^2$). In addition, eight further elongated holes 38*a* are arranged about said center hole 44*a*. As shown in FIG. 5, a corresponding elongated hole 38*a* (as the elongated holes 38*b*, 38*c*, 38*d* also described in following FIGS. 6, 7 and 8) is describable by a radius $r_{LL}$ and a length $l_{LL}$ and defines an axis which is given by the direction of the elongation (i.e. in the direction of the length $l_{LL}$) (cf. here the axes 40, 42). The elongated holes 38*a* shown (just as 38*b*, 38*c*, 38*d* in FIG. 6 or 7 or 8) each comprise a length $l_{LL}$ of 5.25 mm and a radius $r_{LL}$ of 1.05 mm. The elongated holes 38*a* comprise a surface area of a total of 200 $mm^2$.

In addition, the hole pattern 14*a* comprises twenty-six circular, same-size holes 13*a* in the inner region 18*a*. The circular holes 13*a* comprise a radius $r_L$ of approximately 1.5 mm (with a total hole surface of $A_{L.inner}$=1.8 $cm^2$), whilst the outer region 20*a* comprises a total of seventy-two circular holes 13*a* (with a total hole surface of $A_{L.outer}$=5.1 $cm^2$). The hole density of the outer region 20*a* is 3.8%, whilst the hole density of the inner region 18*a* is 10.5%. The hole density of the entire hole pattern is 5.5%. The hole density of the hole pattern 14*a* decreases significantly from the inner region 18*a* of the hole pattern 14*a* to the outer region 20*a* of the hole pattern 14*a*. The ratio of hole density in the inner region to the hole density in the outer region is 2.8.

Figure 6:
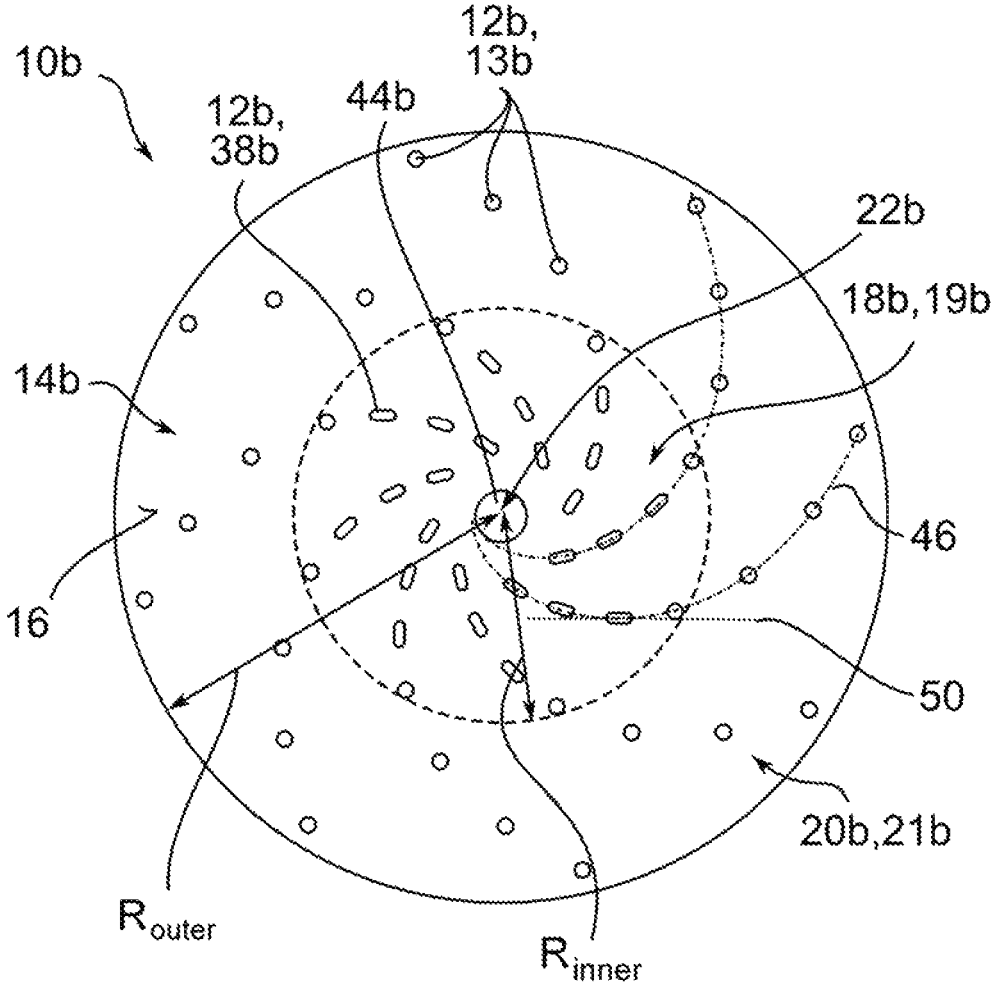
FIG. 6 shows a schematic representation of a second embodiment of an abrasive article according to the disclosure.

FIG. 6 shows an abrasive article 10*b* in the form of a circular abrasive disk. The abrasive article 10*b* comprises a diameter of 15 cm. The abrasive article 10*b* comprises a plurality of holes 12*b* for the extraction of abrasive dust from a machining surface 202 during an abrasive process on the machining surface 202. The plurality of holes 12*b* are arranged in a hole pattern 14*b*, the hole pattern 14*b* covering the entire abrasive article 10*b*—i.e. up to a narrow, insignificant distance from the edge (the envelope of the hole pattern, i.e. a circle enclosing the hole pattern, comprises here a radius of more than $0.98 \times R_{outer}$—consequently, the hole pattern covers more than 96% of the abrasive disk and consequently substantially the entire abrasive disk). The hole pattern 14*b* provides a rotationally symmetrical hole pattern 14*b* (eightfold). The hole pattern 14*b* describes eight spiral lines 46, arranged along the holes 12*b* of the hole pattern 14*b*. The hole pattern 14*b* comprises in the inner region 18*b* twenty-four holes 12*b* formed as elongated hole 38*b* which are arranged along the spiral lines 46. In this case, the spiral lines 46 extend in a common circumferential direction (here anticlockwise). Three elongated holes 38*b* are arranged along the respective spiral line 46 per spiral line 46. The respective elongated holes 38*b* are arranged along a respective spiral line 46 aligned in such a manner that an axis 50 defined by the elongation of the elongated hole 38*b* extends substantially to the spiral line 46. In the center 22*b*, the hole pattern 14*b* comprises a center hole 44*b* which comprises a diameter of 10 mm (surface 78.5 $mm^2$). The spiral lines 46 are formed in such a manner that a tangent to the spiral line provides, as it were, a tangent to the center hole 44*b*. The elongated holes 38*b* comprise a radius $r_{LL}$ of 1.05 mm and a length of 5.25 mm. The elongated holes comprise a surface area of a total of 240 $mm^2$.

In addition, four further circular holes 13*b* are arranged along the respective spiral line 46 per spiral line 46, the respectively three outer circular holes 13*b* being situated in the outer region 20*b* of the abrasive article 10*b* and a circular hole 13*b* still being situated in each case in the inner region. 18*b*. The circular holes 13*b* comprise a radius $r_L$ of approximately 1.5 mm.

The hole pattern 14*b* consequently comprises in the inner region. 18*b* a hole surface of $A_{L.inner}$=3.5 $cm^2$, whilst the outer region 20*b* comprises a hole surface of $A_{L.outer}$=2.0 $cm^2$. The hole density of the outer region 20*b* is consequently 1.5%, whilst the hole density of the inner region 18*b* is 7.9%. The hole density of the entire hole pattern is 3.1%. The hole density of the hole pattern 14*b* decreases significantly from the inner region 18*b* of the hole pattern 14*b* to the outer region 20*b* of the hole pattern 14*b*. The ratio of the hole density in the inner region 18*b* to the hole density in the outer region 20*b* is 5.3.

Figure 7:
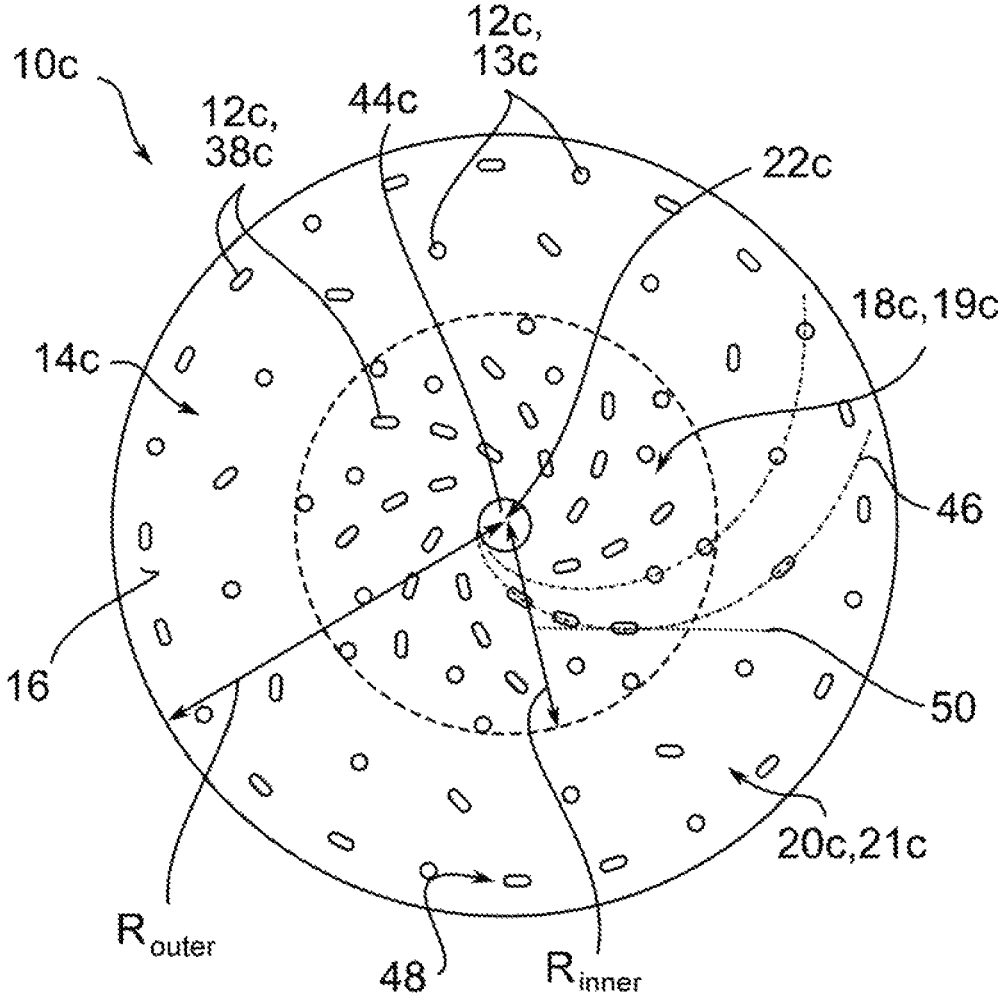
FIG. 7 shows a schematic representation of a third embodiment of an abrasive article according to the disclosure.

FIG. 7 shows an abrasive article 10*c* according to the disclosure in the form of a circular abrasive disk. The abrasive article 10*c* comprises a diameter of 15 cm. The abrasive article 10*c* comprises a plurality of holes 12*c* for the extraction of abrasive dust from a machining surface 202 during an abrasive process on the machining surface 202. The plurality of holes 12*c* are arranged in a hole pattern 14*c*, the hole pattern 14*c* covering the entire abrasive article

10*c*— i.e. up to a narrow, insignificant distance from the edge (the envelope of the hole pattern, i.e. a circle enclosing the hole pattern, comprises here a radius of more than $0.95 \times R_{outer}$— consequently, the hole pattern covers more than 90% of the abrasive disk and consequently substantially the entire abrasive disk). The hole pattern 14*c* also provides a symmetrical hole pattern 14*c*, in particular a rotationally symmetrical (eight-fold symmetry) hole pattern 14*c*. The hole pattern 14*c* describes sixteen spiral lines 46, along which are arranged a plurality of holes 12*c* of the hole pattern 14*c*. Four circular holes 13*c* are arranged in each case along eight spiral lines 46, whilst four elongated holes 38*c* are arranged in each case along four other spiral lines 46. In this case, the spiral lines 46 extend in a circumferential direction (here anticlockwise), a spiral line 46, along which in each case four elongated holes 38*c* are arranged, being followed alternately by a spiral line 46 along which in each case four circular holes 13*c* are arranged. The respective elongated holes 38*c* are arranged along a respective spiral line 46 aligned in such a manner that an axis 50 defined by the elongation of the elongated hole 38*c* extends substantially tangentially to the spiral line 46. In the center 22*c*, the hole pattern 14*c* comprises a center hole 44*c* which comprises a diameter of 10 mm (surface 78.5 $mm^2$). The spiral lines 46 are formed in such a manner that a tangent to the spiral line provides, as it were, a tangent to the center hole 44*c*. In addition, the spiral lines 46 are surrounded by a circle 48 of holes 12*c*, the circle 48 consisting of eight times repeat of the combination "circular hole 13*c*— elongated hole 38*c*-elongated hole 38*c*".

The elongated holes 38*c* comprise a radius $r_{LL}$ of 1.05 mm and a length $l_{LL}$ of 5.25 mm. The elongated holes comprise a surface area of a total of 480 $mm^2$. The circular holes 13*c* have a radius $r_L$ of approximately 1.5 mm and form a surface area of a total of 226 $m^2$. The hole pattern 14*c* comprises in the inner region 18*c* a hole surface of $A_{L.inner}$=4.0 $cm^2$, whilst the outer region 20*c* comprises a hole surface of $A_{L.outer}$=3.8 $cm^2$. The hole density of the outer region 20*c* is consequently 2.9%, whilst the hole density of the inner region 18*c* is 9.1%. The hole density of the overall hole pattern is 4.4%. The hole density of the hole pattern 14*c* decreases significantly from the inner region 18*c* of the hole pattern 14*c* to the outer region 20*c* of the hole pattern 14*c*. The ratio of the hole density in the inner region 18*c* to the hole density in the outer region 20*c* is 3.1.

Figure 8:
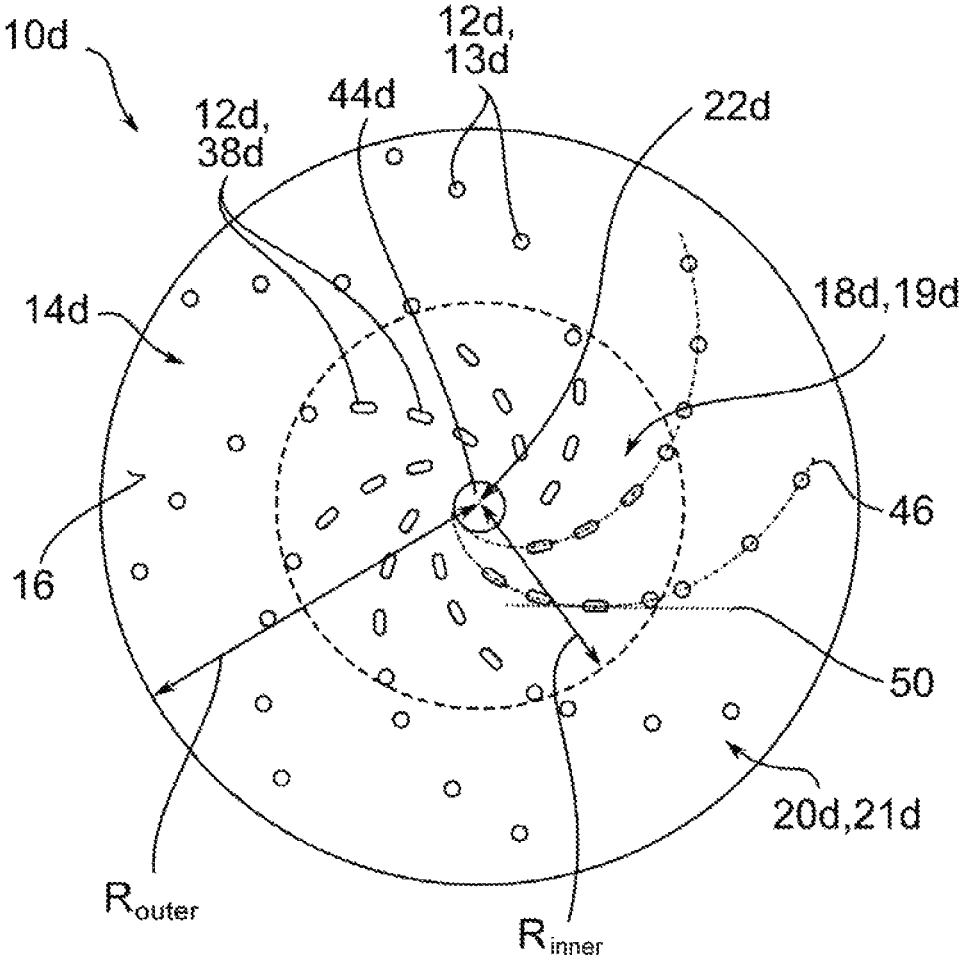
FIG. 8 shows a schematic representation of a fourth embodiment of an abrasive article according to the disclosure.

FIG. 8 shows a slightly modified exemplary embodiment of the abrasive article 10*b* shown in FIG. 6. The abrasive article 10*d* is also realized in the form of a circular abrasive disk and comprises a diameter of 15 cm. The abrasive article 10*d* comprises a plurality of holes 12*d* for the extraction of abrasive dust from a machining surface 202 during an abrasive process on the machining surface 202. The plurality of holes 12*d* are arranged in a hole pattern 14*d*, the hole pattern 14*d* covering the entire abrasive article 10*d*—i.e. up to a narrow, insignificant distance from the edge (the envelope of the hole pattern, i.e. a circle enclosing the hole pattern, comprises here a radius of more than $0.98 \times R_{outer}$— consequently, the hole patters covers more than 96% of the abrasive disk and consequently substantially the entire abrasive disk). The hole pattern 14*d* also describes eight spiral lines 46, along which holes 12*d* of the hole pattern 14*d* are arranged. The hole pattern 14*d* also comprises in the inner region. 18*d* twenty-four holes 12*d* formed as elongate hole 38*d* which are arranged along the spiral lines 46. In this case, the spiral lines 46 extend in a common circumferential direction (here anticlockwise). Three elongated holes are arranged per spiral line 46 along the corresponding spiral line 46. The respective elongated holes 38*d* are arranged along a respective spiral line 46 aligned in such a manner that an axis 50 defined by the elongation of the elongated hole 38*d* extends substantially tangentially to the spiral line 46. In the center 22*d*, the hole pattern 14*d* comprises a center hole 44*d* which comprises a diameter of 10 mm (surface 78.5 $mm^2$). The spiral lines 46 are formed in such a manner that a tangent to the spiral line provides, as it were, a tangent to the center hole 44*d*.

The elongated holes 38*d* comprise a radius $r_{LL}$ of 1.05 mm and a length $l_{LL}$ of 5.25 mm. The elongated holes comprise a surface area of a total of 240 $mm^2$.

In addition, four further circular holes 13*d* are arranged along the respective spiral line 46 per spiral line 46, the respectively three outer circular holes 13*d* being situated in the outer region 20*d* of the abrasive article 10*d* and a circular hole 13*d* still being located in each case in the inner region 18*d*. The circular holes 13*d* comprise a radius $r_L$ of approximately 1.5 mm.

The hole pattern 14*d* consequently comprises in the inner region 18*d* a hole surface of $A_{L.inner}$=3.5 $cm^2$, whilst the outer region 20*d* comprises a hole surface of $A_{L.outer}$=2.0 $cm^2$. The hole density of the outer region 20*d* is consequently 1.5%, whilst the hole density of the inner region 18*d* is 7.9%. The hole density of the overall hole pattern is 3.1%. The hole density of the hole pattern 14*d* decreases significantly from the inner region 18*d* of the hole pattern 14*d* to the outer region 20*d* of the hole pattern 14*d*. The ratio of the hole density in the inner region 18*a* to the hole density in the outer region 20*d* is 5.3.

In contrast to the hole pattern 14*d* shown in FIG. 6, the holes 12*d* in this exemplary embodiment are at various distances along a respective spiral line 46, compared to the distances between the holes 12*d* along an adjacent spiral line 46. The hole pattern 14*d* consequently provides here an asymmetrical, in particular rotationally asymmetrical, rotary asymmetrical, axially asymmetrical, point asymmetrical and translation asymmetrical hole pattern 14*d*. The advantageous effects of a particularly good extraction are further strengthened on account of the asymmetrical distribution of the hole pattern 14*d*.

It must be noted once again that the abrasive article can also be realized in the form of an abrasive belt, an abrasive arch, an abrasive strip or another manufacturing form which appears sensible to an expert. In addition, the exemplary embodiments do not imply any restriction to an abrasive disk with a diameter of 15 cm.

The invention claimed is:

1. An abrasive article comprising: a plurality of holes arranged in a hole pattern in which an areal hole density decreases from an inner region of the hole pattern, which is defined between a center of the abrasive article and an inner region boundary, to an outer region of the hole pattern, which is defined between the inner region boundary and an outer edge of the abrasive article, wherein the hole pattern defines at least one spiral pattern along which at least a portion of the plurality of holes of the hole pattern are arranged, and wherein a first hole density in the inner region of the hole pattern is between 7.5% a nd 16.0% of an overall area of the inner region.

2. The abrasive article as claimed in claim 1, wherein a second hole density in the outer region of the hole pattern is between 1.5% and 4.8% of an overall area of the outer region.

3. The abrasive article as claimed in claim 2, wherein the second hole density is between 2.9% and 3.4% of the overall area of the outer region.

4. The abrasive article as claimed in claim 1, wherein the areal hole density of the hole pattern is between 2.6% and 6.8% of an overall area of the abrasive article.

5. The abrasive article as claimed in claim 4, wherein the areal hole density is between 3.5% and 5.5% of the overall area of the abrasive article.

6. The abrasive article as claimed in claim 1, wherein the hole pattern is at least one of rotationally symmetrical, rotary-symmetrical, axially symmetrical, point symmetrical, and translation symmetrical.

7. The abrasive article as claimed in claim 1, wherein the hole pattern includes at least one elongated hole arranged along each of a plurality of spiral patterns of the at least one spiral pattern.

8. The abrasive article as claimed in claim 1, wherein a respective elongated hole is arranged and aligned along an associated spiral pattern of the at least one spiral pattern in such a manner that an axis defined by an elongation of the respective elongated hole extends substantially tangentially to the associated spiral pattern.

9. The abrasive article as claimed in claim 1, wherein the hole pattern comprises a center hole and a tangent to the center hole forms a tangent to the at least one spiral pattern.

10. The abrasive article as claimed in claim 1, wherein the abrasive article is a coated abrasive disk.

11. The abrasive article as claimed in claim 1, wherein the first hole density is between 9.0% and 12.0% of the overall area of the inner region.

12. The abrasive article as claimed in claim 1, wherein at least one hole of the plurality of holes of the hole pattern is formed as an elongated hole.

13. The abrasive article as claimed in claim 1, wherein at least one hole of the plurality of holes of the hole pattern is formed as a circular hole.

14. The abrasive article as claimed in claim 1, wherein the hole pattern includes at least one circular hole arranged along each of a plurality of spiral patterns of the at least one spiral pattern.

15. The abrasive article as claimed in claim 12, wherein a first number of elongated holes in the inner region of the hole pattern is greater than a second number of elongated holes in the outer region of the hole pattern.

16. An abrasive article comprising: a plurality of holes arranged in a hole pattern in which an areal hole density decreases from an inner region of the hole pattern, which is defined between a center of the abrasive article and an inner region boundary, to an outer region of the hole pattern, which is defined between the inner region boundary and an outer edge of the abrasive article, wherein a ratio of a first hole density in the inner region to a second hole density in the outer region is between 1.9 and 6.9.

17. The abrasive article as claimed in claim 16, wherein a first hole density in the inner region of the hole pattern is between 7.5% and 16.0% of an overall area of the inner region.

18. The abrasive article as claimed in claim 16, wherein the hole pattern defines at least one spiral line pattern along which at least a portion of the plurality of holes of the hole pattern are arranged.

19. The abrasive article as claimed in claim 16, wherein the ratio is between 3.1 and 5.7.

20. An abrasive article comprising: a plurality of holes arranged in a hole pattern in which an areal hole density decreases from an inner region of the hole pattern, which is defined between a center of the abrasive article and an inner region boundary, to an outer region of the hole pattern, which is defined between the inner region boundary and an outer edge of the abrasive article, wherein the plurality of holes of the hole pattern comprises at least one elongated hole, and wherein at least one of: (i) a first elongation of a first elongated hole of the at least one elongated hole is different from a second elongation of a second elongated hole of the at least one elongated hole, and (ii) a first radius of the first elongated hole is different from a second radius of the second elongated hole.

* * * * *